US007928934B2

(12) United States Patent
Kane

(10) Patent No.: US 7,928,934 B2
(45) Date of Patent: Apr. 19, 2011

(54) ACTIVE MATRIX ORGANIC LIGHT EMITTING DIODE DISPLAY

(75) Inventor: Michael G. Kane, Princeton, NJ (US)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 874 days.

(21) Appl. No.: 11/785,768

(22) Filed: Apr. 20, 2007

(65) Prior Publication Data

US 2008/0258607 A1 Oct. 23, 2008

(51) Int. Cl.
*G09G 3/30* (2006.01)

(52) U.S. Cl. ..... 345/76

(58) Field of Classification Search ..... 345/76–83; 313/463, 504; 315/169.3
See application file for complete search history.

(56) References Cited

U.S. PATENT DOCUMENTS 6,841,948 B2 * 1/2005 Yoshida ..... 315/169.3
7,173,585 B2 * 2/2007 Weng ..... 345/82
2005/0093788 A1 * 5/2005 Shin ..... 345/76
2005/0110721 A1 * 5/2005 Shin et al. ..... 345/76
2006/0145989 A1 * 7/2006 Han et al. ..... 345/92

OTHER PUBLICATIONS

Tatsuya Sasaoka et al. "24.4L: Late-News Paper: A 13.0-inch AM-OLED Display with Top Emitting Structure and Adaptive Current Mode Programmed Pixel Circuit (TAC)". SID 01 Digest, pp. 384-387. 2001.
R.N.A Dawson et al. "4.2: Design of an Improved Pixel for a Polysilicon Active-Matrix Organic LED Display". 1998.

* cited by examiner

*Primary Examiner* — Jimmy H Nguyen
(74) *Attorney, Agent, or Firm* — Harness, Dickey & Pierce, P.L.C.

(57) ABSTRACT

A unit pixel of a display includes a driver circuit, a memory circuit and a current controller. The driver circuit is configured to drive a light emitting device. The memory circuit is coupled to the driver circuit, and is configured to store image data for the unit pixel. The current controller circuit is coupled to the driver circuit, and configured to control a current flowing through at least a portion of the driver circuit such that the driver circuit drives the light emitting device with a constant or substantially constant current.

12 Claims, 5 Drawing Sheets

ACTIVE MATRIX ORGANIC LIGHT EMITTING DIODE DISPLAY

BACKGROUND

Description of the Related Art

Conventional active matrix organic light emitting diode (AMOLED) displays have faster response characteristics and wider viewing angles than liquid crystal displays (LCDs). Such conventional AMOLED displays include an organic light emitting diode (OLED) and a driver for driving the OLED in each pixel. The OLED emits light when a current is passed through it. The driver may include a switching transistor allowing access to the pixel, and a driving transistor for supplying a current to the OLED.

In one example, a pixel of a conventional AMOLED display includes a switching transistor, which samples an analog image signal, a memory capacitor, which stores an image signal in the pixel, and a driving transistor, which controls a current supplied to the OLED according to a voltage of the image signal stored in the memory capacitor.

Channels of the switching and driving transistors may be formed of amorphous silicon or polycrystalline silicon. The switching transistor allows a data voltage to be applied to the driving transistor, and thus, requires a low leakage current and fast response characteristics. The driving transistor supplies a current to the OLED and should have uniform characteristics across the display to produce a more uniform image.

Polycrystalline silicon has higher mobility and degrades more slowly during operational life than amorphous silicon. Thus, polycrystalline silicon may be, in some cases, preferred over amorphous silicon. However, polycrystalline silicon may have a relatively high off-current due to a leakage current through grain boundaries.

In addition, polycrystalline silicon has a lower uniformity, and thus, may be more difficult to operate uniformly in each pixel. Self-compensating voltage programmed AMOLED pixels and self-compensating current programmed AMOLED pixels may be used to compensate for this lower uniformity. In compensating for this lower uniformity, however, circuits become complicated due to compensation devices, which in turn, results in more complex designs for manufacturing conventional AMOLED displays.

SUMMARY

Example embodiments relate to active matrix organic light emitting diode (AMOLED) displays which may be more easily manufactured in a simpler structure.

Example embodiments provide active matrix organic light emitting diode (AMOLED) displays which may be more easily manufactured at a higher yield.

At least one example embodiment provides an AMOLED display that may include an organic light emitting diode, a driving transistor, a memory capacitor, a switching transistor, a programming transistor and/or a current controller. The driving transistor may include a drain connected to the organic light emitting diode and a source supplied with a driving voltage for driving the organic light emitting diode. The memory capacitor may be connected to a gate and the source of the driving transistor in parallel. The switching transistor may include a gate and a drain supplied with scan and data signals and a source connected to the gate of the driving transistor. The programming transistor may include a gate and a drain respectively connected to the gate and drain of the switching transistor and a source connected to the drain of the driving transistor. The current controller may determine a current flowing through the driving and programming transistors.

At least one other example embodiment provides an AMOLED display that may include a plurality of scan lines and a plurality of data lines disposed on an X-Y matrix, an organic light emitting diode provided in each of pixel areas defined by the scan lines and the data lines, and a driver driving the organic light emitting diode in each of the pixel areas. The driver may include a driving transistor, a memory capacity, a driving transistor, a switching transistor, a programming transistor and/or a current controller. The driving transistor may include a drain connected to the organic light emitting diode and a source supplied with a driving voltage for driving the organic light emitting diode. The memory capacitor may be connected to a gate and the source of the driving transistor in parallel. The switching transistor may include a gate and a drain connected to the scan and data lines and a source connected to the gate of the driving transistor. The programming transistor may include a gate and a drain respectively connected to the gate and drain of the switching transistor and a source connected to the drain of the driving transistor. The current controller may be connected to the scan lines to determine a current flowing through the driving and programming transistors.

At least one example embodiment provides a unit pixel for a display device. According to at least this example embodiment, the unit pixel may include a driver circuit, and a memory circuit. The driver circuit may be configured to drive a light emitting device. The memory circuit may be coupled to the driver circuit, and may be configured to store image data for the unit pixel. The unit pixel may further include a current controller. The current controller circuit may be coupled to the driver circuit, and may be configured to control a current flowing through at least a portion of the driver circuit such that the driver circuit drives the light emitting device with a constant or substantially constant current.

At least one other example embodiment provides a display including at least one light emitting device, and a unit pixel corresponding to each of the at least one light emitting devices. Each unit pixel may include a driver circuit, and a memory circuit. The driver circuit may be configured to drive a light emitting device. The memory circuit may be coupled to the driver circuit, and may be configured to store image data for the unit pixel. The unit pixel may further include a current controller. The current controller circuit may be coupled to the driver circuit, and may be configured to control a current flowing through at least a portion of the driver circuit such that the driver circuit drives the light emitting device with a constant or substantially constant current.

At least one other example embodiment provides a plurality of scan lines and a plurality of data lines arranged in a matrix. The scan lines and the data lines may define a plurality of unit pixels each of which includes a light emitting device. Each unit pixel may include a driver circuit, and a memory circuit. The driver circuit may be configured to drive a light emitting device. The memory circuit may be coupled to the driver circuit, and may be configured to store image data for the unit pixel. The unit pixel may further include a current controller. The current controller circuit may be coupled to the driver circuit, and may be configured to control a current flowing through at least a portion of the driver circuit such that the driver circuit drives the light emitting device with a constant or substantially constant current.

At least one other example embodiment provides a method of operating a unit pixel of a display. According to at least this example embodiment, a first supply voltage may be supplied to the unit pixel, and the first supply voltage may be switched from a first voltage level to a second voltage level to deactivate a light emitting device included in the unit pixel. The second voltage level may be less than the first voltage level. A program voltage may be stored within a memory circuit using an induced programming current. The programming voltage may be induced within the unit pixel using the supplied first supply voltage. A second supply voltage may be supplied to the unit pixel. The second supply voltage may be sufficient to activate the light emitting device. Current applied to the light emitting device may be controlled according to the stored program voltage.

According to at least some example embodiments, the driver circuit may include a driving circuit, a switching circuit and a programming circuit. The driving circuit may have a first terminal connected to the light emitting device and a second terminal supplied with a driving voltage for driving the light emitting device. The switching circuit may include a first terminal configured to receive data signals, a third terminal configured to receive scan signals, and a second terminal connected to the third terminal of the driving circuit. The programming circuit may include a first terminal connected to the first terminal of the switching circuit, a third terminal connected to the third terminal of the switching circuit and a second terminal connected to the third terminal of the driving circuit.

According to at least some example embodiments, the switching circuit and/or the programming circuit may be transistors (e.g., p-channel transistors). The light emitting device may be an organic light emitting device, for example, including at least one organic light emitting diode. Each unit pixel may be connected to a common current controller.

BRIEF DESCRIPTION OF THE DRAWINGS

The present invention will become more apparent by describing in detail example embodiments thereof with reference to the attached drawings in which.

DETAILED DESCRIPTION OF EXAMPLE EMBODIMENTS

Figure 1:
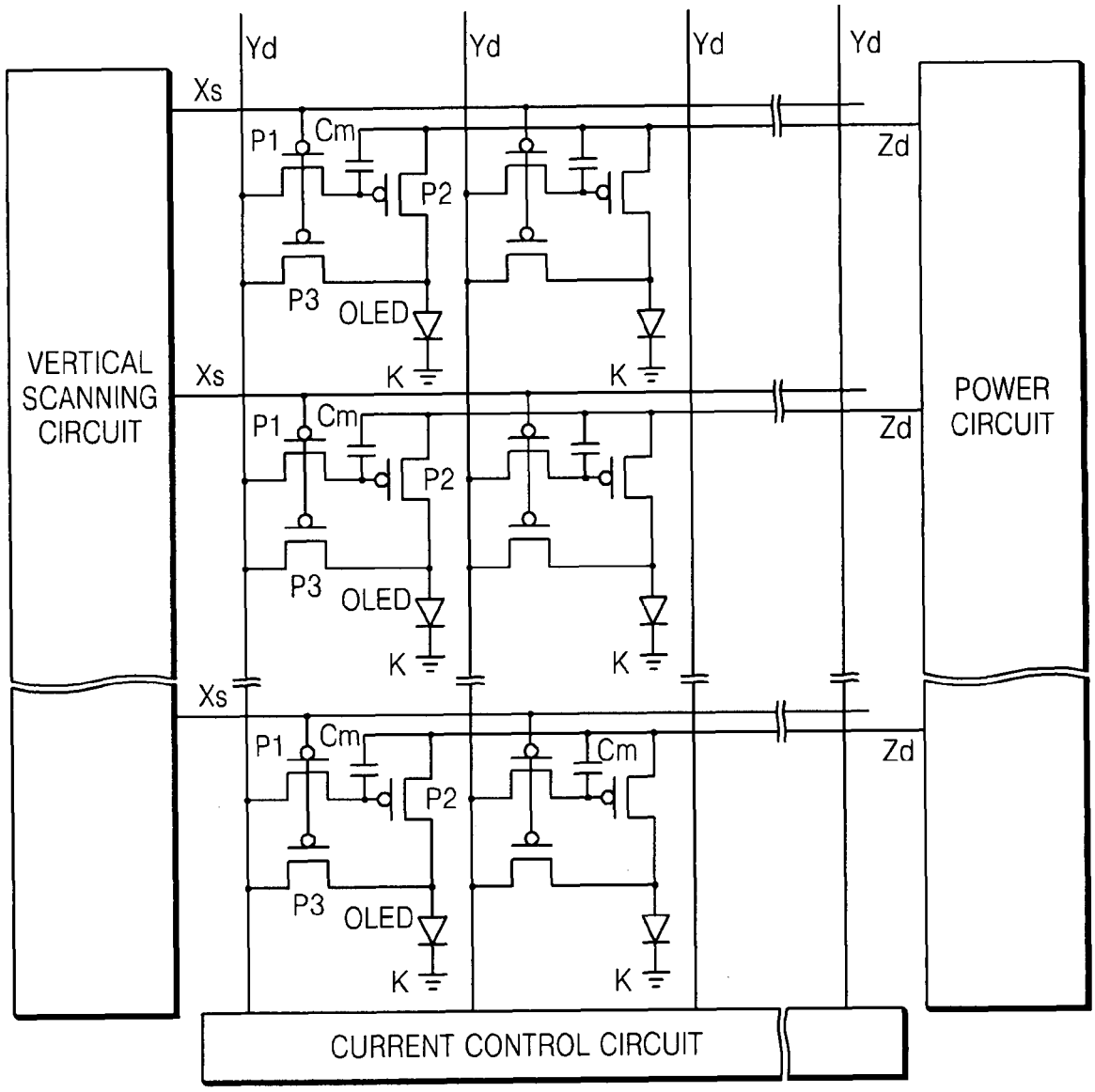
FIG. 1 is a schematic equivalent circuit diagram of a display device according to an example embodiment.

Various example embodiments will now be described more fully with reference to the accompanying drawings in which some example embodiments are shown. In the drawings, the thicknesses of layers and regions are exaggerated for clarity.

Detailed illustrative example embodiments are disclosed herein. However, specific structural and functional details disclosed herein are merely representative for purposes of describing example embodiments. This invention may, however, may be embodied in many alternate forms and should not be construed as limited to only the example embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element or layer is referred to as being "formed on" another element or layer, it can be directly or indirectly formed on the other element or layer. That is, for example, intervening elements or layers may be present. In contrast, when an element or layer is referred to as being "directly formed on" to another element, there are no intervening elements or layers present. Other words used to describe the relationship between elements or layers should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the FIGS. For example, two FIGS. shown in succession may in fact be executed substantially concurrently or may sometimes be executed in the reverse order, depending upon the functionality/acts involved.

An active matrix organic light emitting diode (AMOLED) display according to an example embodiment of the present invention will now be described in detail with reference to the attached drawings.

FIG. 1 is a schematic equivalent circuit diagram of a display device (e.g., an AMOLED display) according to an example embodiment. Referring to FIG. 1, a plurality of scan lines Xs may be aligned orthogonal to a plurality of data lines Yd to form a matrix structure. Power lines Zd may be in parallel with the scan lines Xs at given or desired distances from the scan lines Xs. Pixels may be positioned around intersections between the scan lines Xs and the data lines Yd. Vertical scan signals may be applied to the scan lines Xs and data current signals may be applied to the data lines Yd. The scan lines Xs may be connected to a vertical scanning circuit, and the data lines Yd may be connected to a current controller circuit. The power lines Zd may be connected to a power circuit for powering the AMOLED display device.

Each unit pixel (or pixel) may include a driver circuit P1, P2, P3 including at least a switching circuit P1, a driving circuit P2 and a programming circuit P3. According to at least one example embodiment, the driver circuit P1, P2, P3 may include three transistors (e.g., p-channel transistors), wherein the switching circuit P1 may be a switching transistor (e.g., p-channel transistor), the driving circuit P2 may be a driving transistor (e.g., p-channel transistor) and the programming circuit P3 may be a programming transistor (e.g., p-channel transistor). Each unit pixel may further include a memory circuit Cm. According to at least one example embodiment, the memory circuit Cm may be a capacitor. Example embodiments will be discussed herein with regard to transistors, for example, p-channel transistors; however, the switching circuit P1, the driving circuit P2 and/or the programming circuit P3 may have any other suitable configuration. Example embodiments will also be discussed herein with regard to the capacitor; however, the memory circuit Cm may have any other suitable configuration.

In each unit pixel, a gate and a drain of the switching transistor P1 may be connected to the scan line Xs and-the data line Yd, and a source of the switching transistor P1 may be connected to a gate of the driving transistor P2. The memory capacitor Cm may store image data for each pixel and may be connected to the gate and source of the driving transistor P2 in parallel. An anode of an OLED may be connected to a drain of the driving transistor P2. A cathode K of the OLED may correspond to a common electrode shared by the entire display. According to example embodiments, the gate and the drain of the programming transistor P3 may be connected to the gate and the drain of the switching transistor P1, and the source of the programming transistor P3 may be connected to the drain of the driving transistor P2.

Figure 2:
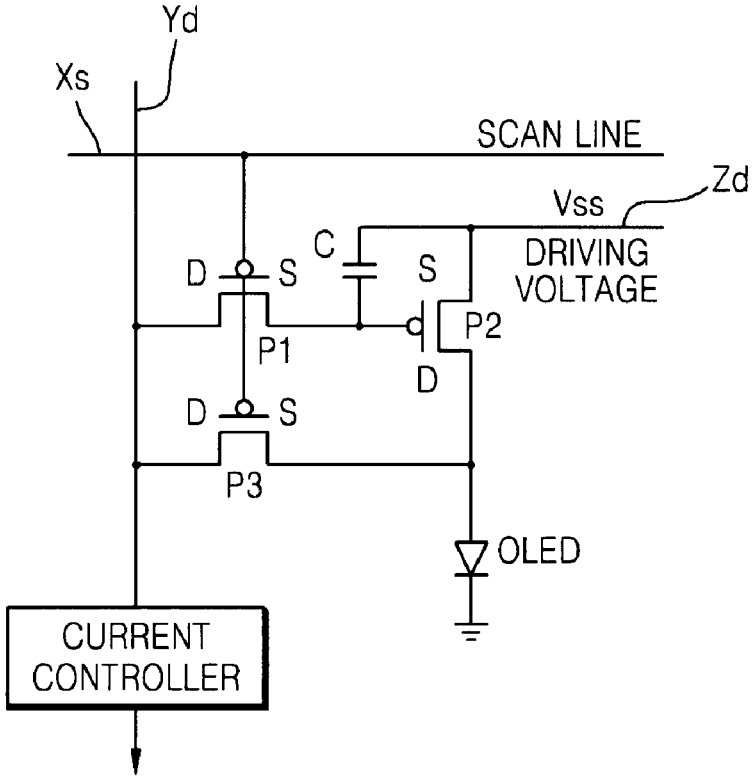
FIG. 2 is an equivalent circuit diagram of a unit pixel according to an example embodiment.

FIG. 2 is an equivalent circuit diagram of a unit pixel of a display device according to an example embodiment. The unit pixel (or pixel) in FIG. 2 may include a driver circuit P1, P2, P3, a memory circuit Cm and a current controller circuit. The driver circuit P1, P2, P3 may include at least a switching circuit P1, a driving circuit P2 and a programming circuit P3. According to at least one example embodiment, the driver circuit P1, P2, P3 may include three transistors (e.g., p-channel transistors), wherein the switching circuit P1 may be a switching transistor (e.g., p-channel transistor), the driving circuit P2 may be a driving transistor (e.g., p-channel transistor) and the programming circuit P3 may be a programming transistor (e.g., p-channel transistor). The memory circuit Cm may be a capacitor. Example embodiments will be discussed herein with regard to transistors, for example, p-channel transistors; however, the switching circuit P1, a driving circuit P2 and/or a programming circuit P3 may have any other suitable configuration. Example embodiments will also be discussed herein with regard to a capacitor; however, the memory circuit Cm may have any other suitable configuration.

Referring still to FIG. 2, gates and drains of the switching and programming transistors P1 and P3 may be connected to the scan line Xs to which the vertical scan signal may be input and the data line Yd, which is orthogonal to the scan line Xs and to which the data current signal may be applied. Thus, the switching and programming transistors P1 and P3 may operate (e.g., concurrently or simultaneously) in response to the vertical scan signal and the data current signal respectively applied to the scan line Xs and the data line Yd, respectively.

The anode of the OLED and the source of the programming transistor P3 may be connected to the drain of the driving transistor P2. Also, the ends of the memory capacitor Cm may be connected to the gate and source of the driving transistor P2. A supply voltage Vss may be applied to the source of the driving transistor P2 through the power line Zd.

A current controller circuit (or current controller, e.g., a current driving integrated circuit (IC)) as described above is connected to the data line Yd. The current controller may determine a current flowing through the driving transistor P2 regardless of a threshold voltage of the driving transistor P2 to store a voltage corresponding to the current in the memory capacitor Cm. According to at least one example embodiment, the current controller may control a current flowing through at least a portion of the driver circuit P1, P2, P3 such that the driver circuit P1, P2, P3 drives the OLED with a constant or substantially constant current.

An example operation of the pixel of FIG. 2 will now be described.

A pixel circuit of the AMOLED display according to at least one example embodiment is of a current programmed-type having, for example, a 3 transistor-1 capacitor (3T-1C) structure including three transistors (e.g., p-channel transistors) P1, P2, and P3 and a memory capacitor Cm. However, any other suitable structure may be used.

An amount of a current flowing in the OLED may be controlled by the driving transistor P2. An amount of a current flowing in the driving transistor P2 may be controlled by a voltage formed between a gate node and a source node of the driving transistor P2. Also, a voltage corresponding to a current flowing between the source and drain of the driving transistor P2 may be stored and maintained in the memory capacitor Cm for a frame. A voltage at the both ends of the memory capacitor Cm may be generated (e.g., automatically generated) by a current flowing through the driving transistor P2. According to at least this example embodiment, a driving voltage may be applied to the source of the driving transistor P2 from the power line Zd, and a current, which flows through the current controller connected to the data line Yd, is allowed to flow through the driving transistor P2. If a given or desired current flows through to the driving transistor P2 and the current controller, a voltage corresponding to the current may be induced (e.g., automatically induced) across the memory capacitor Cm. In at least this example embodiment, the switching and programming transistors P1 and P3 may be turned on due to a scan signal, and an amount of a flowing current may be controlled by the current controller.

A constant current may flow in the OLED regardless of a characteristic difference caused by a position and a process of a thin film transistor array. Thus, a more uniform luminance characteristic may be obtained.

Figure 6:
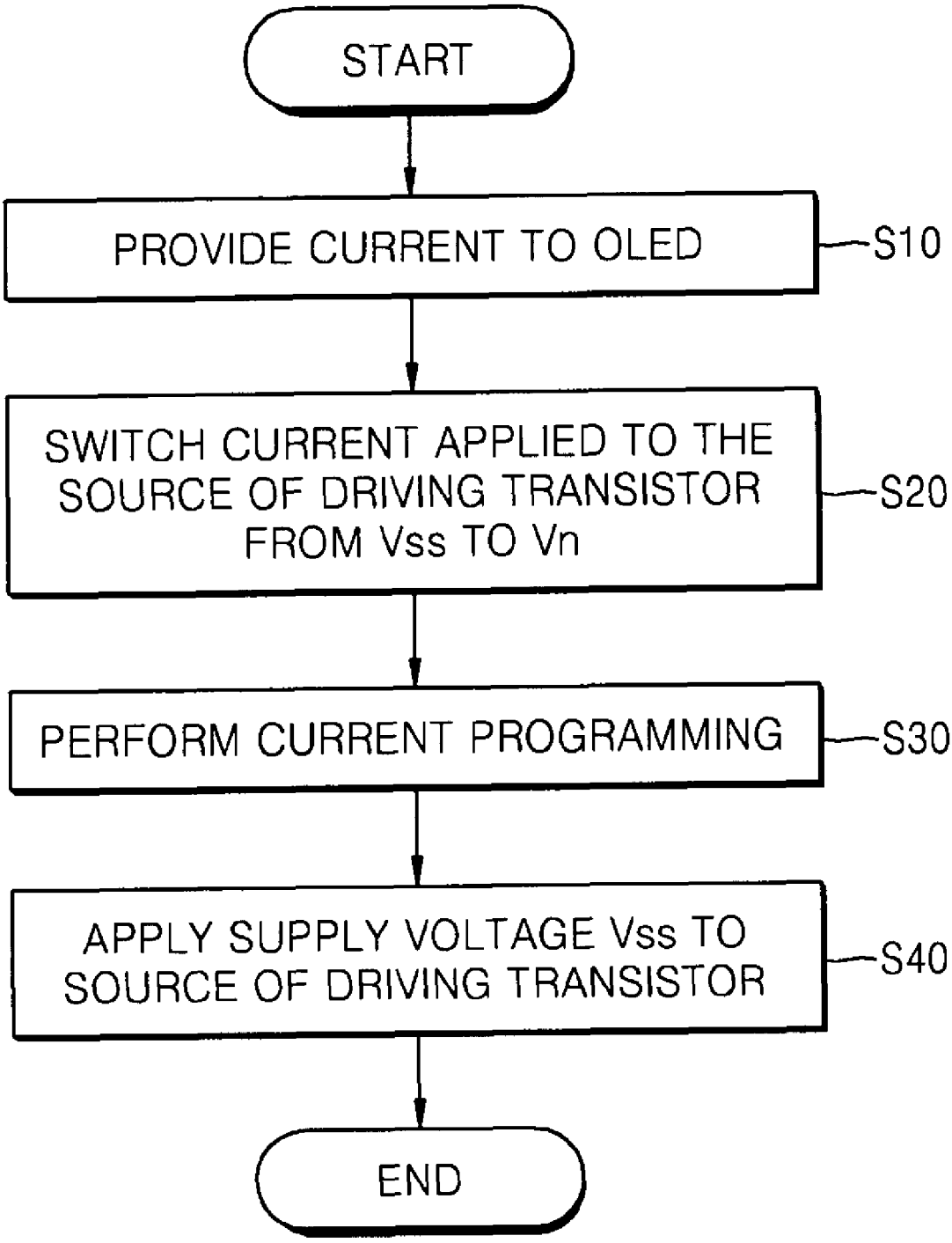
FIG. 6 illustrates a method of operating a unit pixel according to an example embodiment.

FIG. 6 illustrates a method of operating a unit pixel of a display device according to an example embodiment. The method of FIG. 6 may be performed by the display shown in FIG. 1, for example. The method of FIG. 6 will be described with regard to the unit pixel of FIGS. 2, 3A and 3B.

Referring to FIG. 6, switching and programming transistors P1 and P3 may be off, and driving transistor P2 may provide a current to the OLED from a previous frame at S10. At S20, the voltage applied to the source node of driving transistor P2 may be switched from the level Vss to a lower voltage level Vn. Voltage level Vn may be a voltage sufficient to turn off or deactivate the OLED.

Figure 3A:
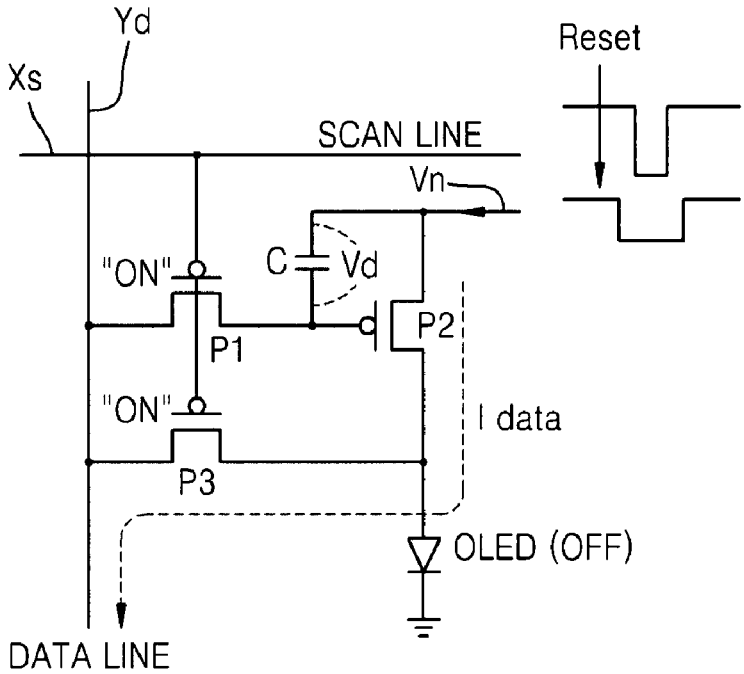
FIGS. 3A and 3B are equivalent circuit diagrams of the unit pixel for illustrating an example operation of a display device according to an example embodiment.

At S30, current programming may be performed by applying a corresponding signal to the scan line to turn on or activate the switching and programming transistors P1 and P3. According to at least this example embodiment, a programming current Idata may flow through the data line, the source and drain of the driving transistor P2 and the source and drain of the programming transistor P3. An amount of (e.g., the size of) the programming current Idata may be determined by the current controller as described above. As a result, a voltage Vd corresponding to the programming current Idata may be induced between the gate and source of the driving transistor P2, and across the memory capacitor Cm as shown in FIG. 3A.

Figure 3B:
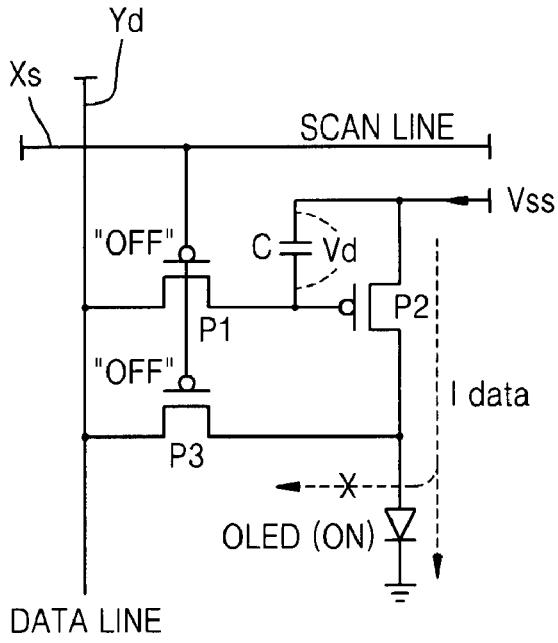

At S40, after the corresponding signal applied to the scan line is changed to turn off or deactivate the switching and programming transistors P1 and P3, a supply voltage Vss may be applied to the source of the driving transistor P2. The supply voltage Vss may be sufficient for the operation of (e.g., to activate) the OLED. In this example, a current supplied to the OLED may be controlled according to the voltage stored in the memory capacitor Cm. This voltage may be induced so as to correspond to a current necessary for the OLED in a programming process. As a result, a desired amount of current may be supplied to the OLED as shown in FIG. 3B.

If methods according to example embodiments are used, differences between threshold voltages of the driving transistors may be suppressed and/or eliminated. In addition, a more uniform programming current Idata may be supplied to OLEDs of all or substantially all pixels. Thus, pixels showing more uniform brightness on the display (e.g., the entire display) may be produced.

Figure 4:
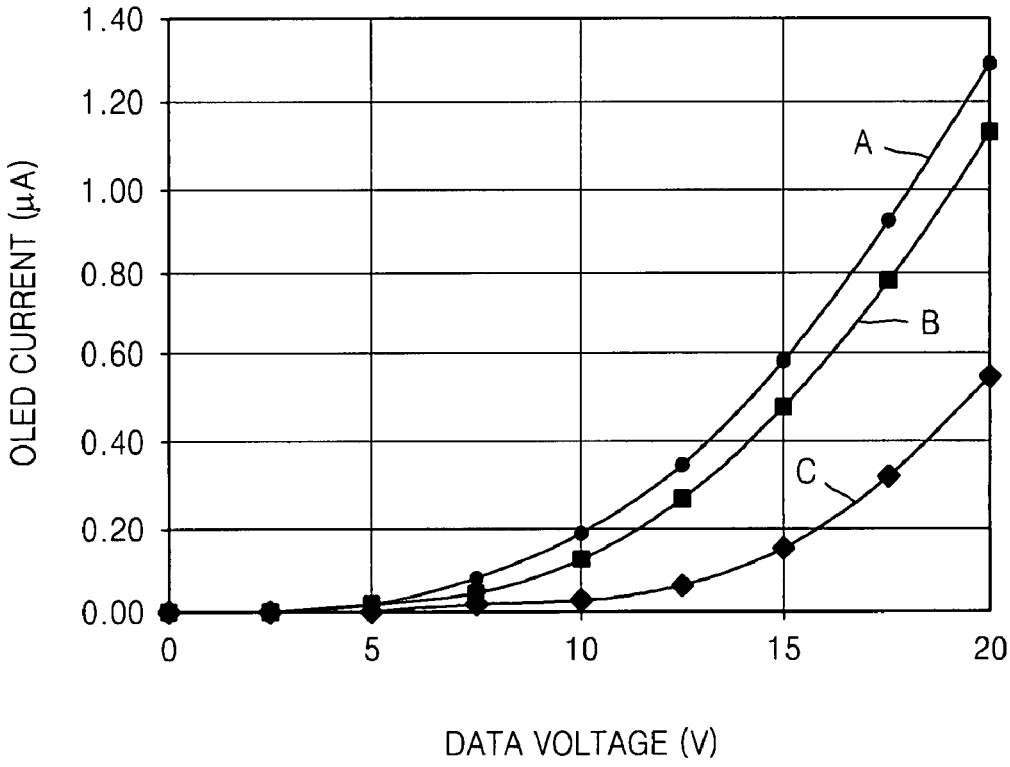
FIGS. 4 and 5 are graphs illustrating example results of simulations performed on a performance of the AMOLED display of FIG. 1.
Figure 5:
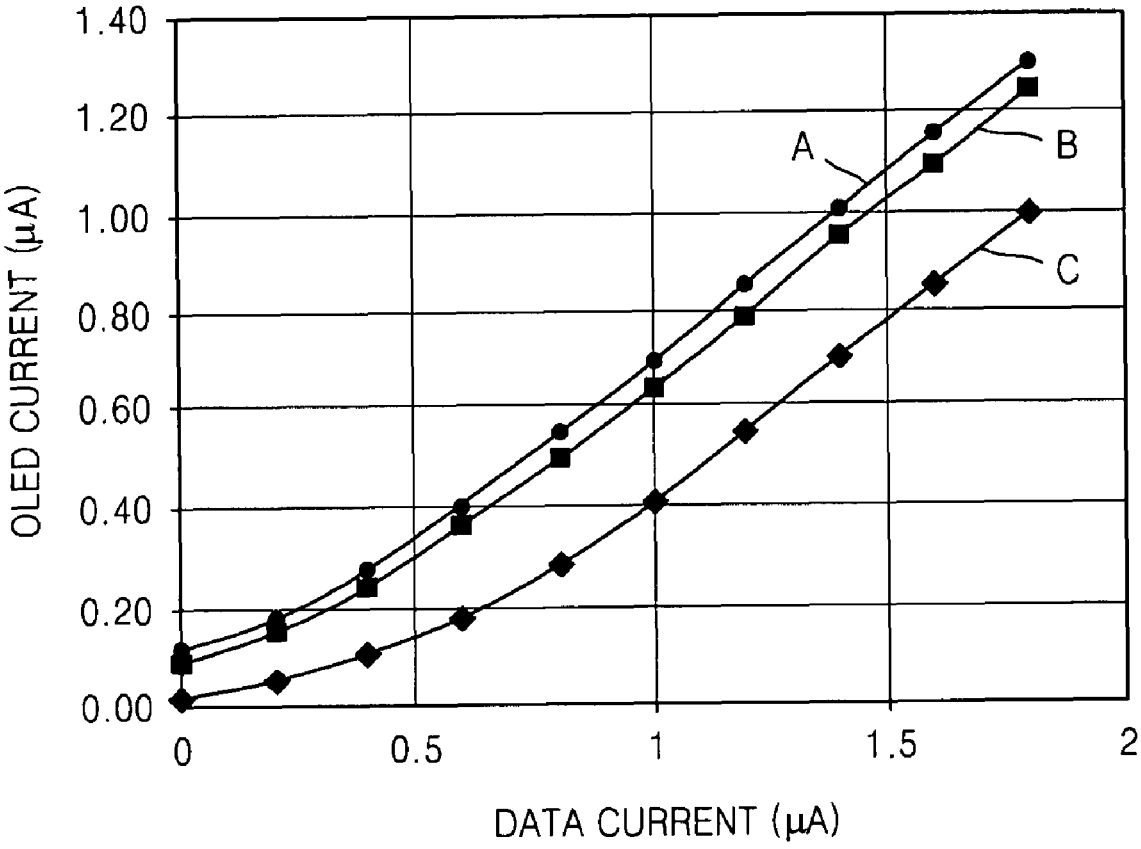

FIGS. 4 and 5 are graphs illustrating results of simulations performed on a performance of a unit pixel of a display device of FIG. 1. FIG. 4 illustrates a relationship between a data voltage and an OLED current, and FIG. 5 illustrates a relationship between a data current and an OLED current.

Referring to FIGS. 4 and 5, "A" indicates a threshold voltage which has not shifted, "B" indicates a threshold voltage which has been shifted by −1V, and "C" indicates a threshold voltage which has been shifted by −5V.

According to the results of the simulations, an error of 58% occurs in the shift of the threshold voltage of −5V in the conventional method. However, an error of only 22% occurs in example embodiments.

As described above, in display devices according to example embodiments, a current programming method may be used to supply a more uniform current to OLEDs of all or substantially all pixels regardless of a difference in a threshold voltage of a driving transistor of each of the pixels. Thus, an image having more uniform brightness may be provided. According to experimental results, a current may be controlled more precisely with respect to a shift of a threshold voltage Vth of the driving transistor than in conventional methods. Such a current programmed type display according to example embodiments may have a simpler structure than conventional current programmed self-compensating pixel circuits.

While the present invention has been particularly shown and described with reference to example embodiments thereof, it will be understood by those of ordinary skill in the art that various changes in form and details may be made therein without departing from the spirit and scope of the present invention as defined by the following claims.

What is claimed is:

1. An AMOLED (organic light emitting diode) display comprising:
- an organic light emitting device;
- a pixel circuit having a 3 transistor-1 capacitor (3T-1C) structure having only three transistors and only one capacitor, the pixel circuit including,
  - a driving transistor comprising a drain connected to the organic light emitting device and a source supplied with a driving voltage for driving the organic light emitting device;
  - a memory capacitor connected to a gate and the source of the driving transistor in parallel;
  - a switching transistor comprising a gate and a drain supplied with scan and data signals, respectively, and a source connected to the gate of the driving transistor;
  - a programming transistor comprising a gate and a drain respectively connected to the gate and drain of the switching transistor and a source connected to the drain of the driving transistor; and
- a current controller determining a current flowing through the driving and programming transistors; wherein
- said driving voltage switches between a first voltage level and a second voltage level,
- said first voltage level is sufficient to turn on the organic light emitting device,
- said second voltage level is sufficient to turn off the organic light emitting device, and
- said programming and switching transistors are simultaneously or concurrently activated during a period starting after said driving voltage switches from said first voltage level to said second voltage level and ending before said driving voltage switches from said second voltage level to said first voltage level.

2. The AMOLED display of claim 1, wherein the driving, switching, and programming transistors are p-channel.

3. The AMOLED display of claim 1, wherein the drain of the driving transistor is directly connected to the organic light emitting device.

4. The AMOLED display of claim 1, wherein the current controller determines the current flowing through the driving transistor regardless of a threshold voltage of the driving transistor to store a voltage corresponding to the current in the memory capacitor.

5. The AMOLED display of claim 1, wherein the gate of the programming transistor is directly connected to the gate of the switching transistor.

6. The AMOLED display of claim 1, wherein the source of the programming transistor and the drain of the driving transistor are commonly and directly connected to the organic light emitting device.

7. An AMOLED display comprising:
- a plurality of scan lines and a plurality of data lines disposed on an X-Y matrix;
- an organic light emitting device provided in each of pixel areas defined by the scan lines and the data lines; and
- a driver driving the organic light emitting device in each of the pixel areas, wherein the driver comprises:
  - a pixel circuit having a 3 transistor-1 capacitor (3T-1C) structure having only three transistors and only one capacitor, the pixel circuit including,
    - a driving transistor comprising a drain connected to the organic light emitting device and a source supplied with a driving voltage for driving the organic light emitting device,
    - a memory capacitor connected to a gate and the source of the driving transistor in parallel,
    - a switching transistor comprising a gate and a drain connected to the scan and data lines, respectively, and a source connected to the gate of the driving transistor, and
    - a programming transistor comprising a gate and a drain respectively connected to the gate and drain of the switching transistor and a source connected to the drain of the driving transistor; and
- a current controller connected to the data lines to determine a current flowing through the driving and programming transistors; wherein said driving voltage switches between a first voltage level and a second voltage level, said first voltage level is sufficient to turn on the organic light emitting device, said second voltage level is sufficient to turn off the organic light emitting device, and said programming and switching transistors are simultaneously or concurrently activated during a period starting after said driving voltage switches from said first voltage level to said second voltage level and ending before said driving voltage switches from said second voltage level to said first voltage level.

8. The AMOLED display of claim 7, wherein the driving, switching, and programming transistors are p-channel.

9. The AMOLED display of claim 7, wherein the drain of the driving transistor is directly connected to the organic light emitting device.

10. The AMOLED display of claim 7, wherein the current controller determines the current flowing through the driving transistor regardless of a threshold voltage of the driving transistor to store a voltage corresponding to the current in the memory capacitor.

11. The AMOLED display of claim 7, wherein the gate of the programming transistor is directly connected to the gate of the switching transistor.

12. The AMOLED display of claim 7, wherein the source of the programming transistor and the drain of the driving transistor are commonly and directly connected to the organic light emitting device.

* * * * *